United States Patent [19]

Polan

[11] Patent Number: 4,647,345

[45] Date of Patent: Mar. 3, 1987

[54] METALLURGICAL STRUCTURE CONTROL OF ELECTRODEPOSITS USING ULTRASONIC AGITATION

[75] Inventor: Ned W. Polan, Madison, Conn.

[73] Assignee: Olin Corporation, New Haven, Conn.

[21] Appl. No.: 871,193

[22] Filed: Jun. 5, 1986

[51] Int. Cl.[4] ..... C25D 1/04

[52] U.S. Cl. ..... 204/13; 204/216

[58] Field of Search ..... 204/13, 208, 216, 222

[56] References Cited

U.S. PATENT DOCUMENTS

| | | | |
|---|---|---|---|
| 1,417,464 | 5/1922 | Edison | 204/13 |
| 1,543,861 | 6/1925 | McCord | 204/13 |
| 1,952,762 | 3/1934 | Levy et al. | 204/216 |
| 2,044,415 | 6/1936 | Yates | 204/13 |
| 2,865,830 | 12/1958 | Zoldas | 204/208 |
| 3,151,048 | 9/1964 | Conley et al. | 204/13 |
| 3,351,539 | 11/1967 | Branson | 204/222 |
| 3,461,046 | 8/1969 | Clancy | 204/13 |
| 4,318,794 | 3/1982 | Adler | 204/216 |
| 4,529,486 | 7/1985 | Polan | 204/13 |

FOREIGN PATENT DOCUMENTS

| | | | |
|---|---|---|---|
| 1543301 | 4/1979 | United Kingdom | 204/13 |
| 1548550 | 7/1979 | United Kingdom | 204/13 |

*Primary Examiner*—T. M. Tufariello

*Attorney, Agent, or Firm*—Barry L. Kelmachter; Howard M. Cohn; Paul Weinstein

[57] ABSTRACT

A system for producing continuous lengths of electroformed metal foil or strip having enhanced ductility and a moderately refined grain structure is described. The system includes an anode and a cathode having a moving plating surface at least partially immersed within an electrolytic solution. To obtain the aforementioned improvements in foil or strip properties, the electrolytic solution is sonically agitated in the vicinity of the moving plating surface. Preferably, one or more ultrasonic generators are used to agitate the electrolyte. The generators may be mounted in a variety of locations including within the electrolyte flow path, within one of the anode and the cathode, or in contact with a surface of either the anode or the cathode.

21 Claims, 5 Drawing Figures

METALLURGICAL STRUCTURE CONTROL OF ELECTRODEPOSITS USING ULTRASONIC AGITATION

The present invention relates to a process and apparatus for electroforming metals in strip or foil form.

Electroformed or electrodeposited metal foil, especially copper foil, is widely used in the production of printed circuits for electronic and electrical applications. The basic electroforming technology is old and well known in the art. U.S. Pat. Nos. 1,417,464 to Edison and 1,543,861 to McCord demonstrate this. The equipment for producing electroformed metal foil typically includes a tank or cell for holding an electrolytic solution containing values of the metal to be deposited and two electrodes, a cathode and an anode. The two electrodes are mounted on or within the tank to be at least partially immersed within the electrolyte. By applying an electrical current to the electrodes, metal is deposited onto an immersed surface of the cathode. By rotating the cathode, metal in foil or strip form can be continually produced.

The cathodes and the anodes used for electroforming metal foil or strip may have a variety of configurations. The cathode generally comprises a rotating cylindrical drum while the anode generally comprises a split anode arrangement having two arcuately shaped, spaced-apart solid anode sections. Each anode section is usually somewhat less in length than one-fourth of the circumference of the drum cathode and mounted within the tank to be substantially concentric with the rotating drum cathode. The primary reason for providing such an anode arrangement is to promote the formation of metal foil having a uniform thickness by maintaining a substantially uniform spacing between the cathode and the anode. The use of a split anode arrangement also enables a central passageway and/or manifold to be used to feed the electrolyte across the bottom of the rotating drum cathode and into the interelectrode gap between the cathode and the anode sections. U.S. Pat. Nos. 2,044,415 to Yates, 2,865,830 to Zoldas and 3,461,046 to Clancy illustrate typical electroforming systems.

Depending upon the length of the anodes, the type of system employed and the type of deposit to be formed on the rotating cathode, more than two anodes may be used if desired. U.S. Pat. No. 1,952,762 to Levy et al. illustrates an anode configuration comprising two anodes and a pair of spaced apart additional anode plates. The additional anode plates are provided in an attempt to form an anode that extends around substantially the entire submerged portion of the rotating drum cathode. U.K. Pat. Nos. 1,543,301 and 1,548,550 illustrate anode configurations having a plurality of sections. The anode is divided into a plurality of sections to provide additional passageways through which electrolyte can be provided to the interelectrode gap and/or to facilitate the application of different voltages to diffferent anode sections so that metal foil is formed in a first zone and a nodular or dendritic layer is formed on the electroformed foil in a second zone.

The production of substantially uniform metal foil and strip having a substantially uniform thickness has been a goal of foil and strip producers for some time. Several factors have lead to difficulties in producing substantially uniform foil and strip. These factors include the need to use high electrolyte flow rates and the absence of fresh metal species at the plating surface. High electrolyte flow rates are troublesome for a number of reasons. First, high speed electrolyte passing through the central gap in a split anode arrangement impinges directly on the plating surface of the moving cathode immediately above the gap. This impinging electrolyte flow disturbs the evenness of the current distribution in the area immediately above the gap which leads to uneven plating in this area. Second, the impinging electrolyte flow causes erosion of both the cathode and the plating surface. U.S. Pat. No. 4,529,486 to Polan illustrates one attempt for dealing with this problem. In the system described in the Polan patent, an anode construction having a central perforated zone is used to break up the electrolyte flow entering the interelectrode gap and for generating a more uniform current distribution throughout the plating zone.

The problem of getting fresh metal species to the plating surface has been dealt with in a variety of ways. One approach for dealing with this problem has been to use an anode formed from a foraminous expanded metal structure and a system for supplying electrolyte through the openings of the anode structure. This approach is illustrated in U.S. Pat. No. 4,318,794 to Adler. Another approach involves the use of a plurality of agitator pipes throughout the plating zone to establish a smooth yet turbulent agitation of the electrolyte in the plating zone. U.S. Pat. No. 3,151,048 to Conley et al. illustrates this approach.

In static electroplating systems, similar problems exist with respect to the availability of metal species at the plating electrode. In static systems, the concentration of metal species within the bulk electrolyte may not be uniform. Consequently, it becomes desirable to agitate the bulk electrolyte. U.S. Pat. No. 3,351,539 to Branson suggests that sonic or ultrasonic generators immersed in an electrolyte may be used to agitate the electrolyte to provide uniform concentration thereof. Dynamic metal foil and strip electroforming systems are sufficiently different however that bulk electrolyte agitation techniques are inappropriate. In a static system, plating is carried out for a relatively short time on a cathode which is generally removed upon completion of the plating cycle, thus the electrolyte may be agitated in bulk. In a system for continuously electroforming metal foil or strip, agitation of the electrolyte is needed to continually provide fresh metal species to the moving plating surface. The ability to continually provide fresh metal species to the plating surface is important if substantially uniform foil or strip is to be produced. Furthermore, it is needed only in the relatively small interelectrode gap between the anode and the moving cathode.

Superior ductility is a highly desirable property in electroformed metal foil or strip. Generally, superior ductility is obtained by using low operating current densities. The problem with this approach however, is that high operating current densities are often needed to maximize deposition rates. One approach for increasing the limiting current in order to operate at higher current densities is to increase the electrolyte flow rate. This has the effect of reducing the thickness of the boundary diffusion layer which increases the concentration of available plating species in the vicinity of the plating surface. High flow rates require high electrolyte pumping capacity and as previously discussed accelerate wear and erosion of the plating components. Thus, a tradeoff exists between deposition rate and the capital, maintenance and down time costs associated with high pumping.

Unlike conventional cast and wrought metallic materials where ductility increases with grain size, both ductility and strength decrease in the case of thin electroformed sheet and foil when the grain size approaches that of the foil thickness. Commercially available electroformed metals, particularly copper foil, generally contain coarse columnar grains which individually extend across much or most of the foil cross section. Additives such as gelatin are often used to produce foil having useful ductility properties. However, the use of these additives appears to be generally limited to relatively low current densities on the order of about 0.3 $A/cm^2$. At higher, more desirable current densities, both grain size and ductility are markedly decreased in the presence of these additives. This loss of ductility is believed to be attributable to the combined effects of severe grain size reduction and the incorporation of impurities, additives, and decomposition products of additives in the deposits, particularly at the grain boundaries. Other properties of the foil such as electrical conductivity, strength, toughness, corrosion resistance, and bond strength may also be seriously degraded.

Accordingly, it is an object of the present invention to produce metal strip or foil having enhanced ductility.

It is a further object of the present invention to provide a process and apparatus for producing such metal strip or foil.

It is a further object of the present invention to provide a process and apparatus as above which does not require the use of plating additives.

It is a further object of the present invention to provide a process and apparatus as above which does not require the use of relatively high electrolyte flow rates to achieve relatively high deposition rates.

These and further objects and advantages will become apparent from the following description and drawings in which like reference numerals depict like elements.

In accordance with the present invention, electroformed metal foil or strip having enhanced ductility is produced through the use of sonic, preferably ultrasonic, agitation of the electrolyte during the electroforming process. It has been suprisingly found that by agitating the electrolyte in this manner, one is able to obtain without the use of plating additives, electroformed metal foil having enhanced ductility and a moderately refined and equalized grain size. The ability to obtain a moderate refinement in grain size is significant in that the fairly coarse surface roughness desired for printed circuit applications can be maintained while avoiding the embrittling effects of very small grain size. In addition, by raising the limiting current density of the system through adjustment of certain physical parameters such as electrolyte temperature and/or available concentration of the metal species to be plated, the process of the present invention permits the production of foil at higher deposition rates and under less strenuous operating conditions. For example, it is not necessary to use high electrolyte flow rates in the system of the present invention to obtain high deposition rates, thus less pumping capacity is required resulting in reduced erosion damage of the associated hardware.

The system for producing electroformed metal foil of the present invention includes a rotating drum cathode, at least partially immersed within an electrolyte, and a split anode formed from two arcuately shaped, spaced-apart anode sections. A manifold is provided for circulating electrolyte through the gap between the anode sections and into the interelectrode gap. To achieve the desired results, the system of the present invention includes a means for sonically agitating the electrolyte within the interelectrode gap. The agitating means comprises one or more sonic generators, preferably ultrasonic generators, either positioned in contact with one of the electrodes, incorporated within one of the electrodes, or positioned within the electrolyte flow path.

Electroformed metal foil or strip having superior ductility is formed in accordance with the present invention by applying sonic agitation to the electrolyte during the electroforming process. While the invention is described in the context of forming copper foil, the process and apparatus of the present invention have utility in producing other electroformed metals and metal alloys. Similarly, while the invention is described in the context of forming metal foil, other continuous or non-continuous metal products such as metal strip could be produced using the process and apparatus of the present invention.

Figure 1:
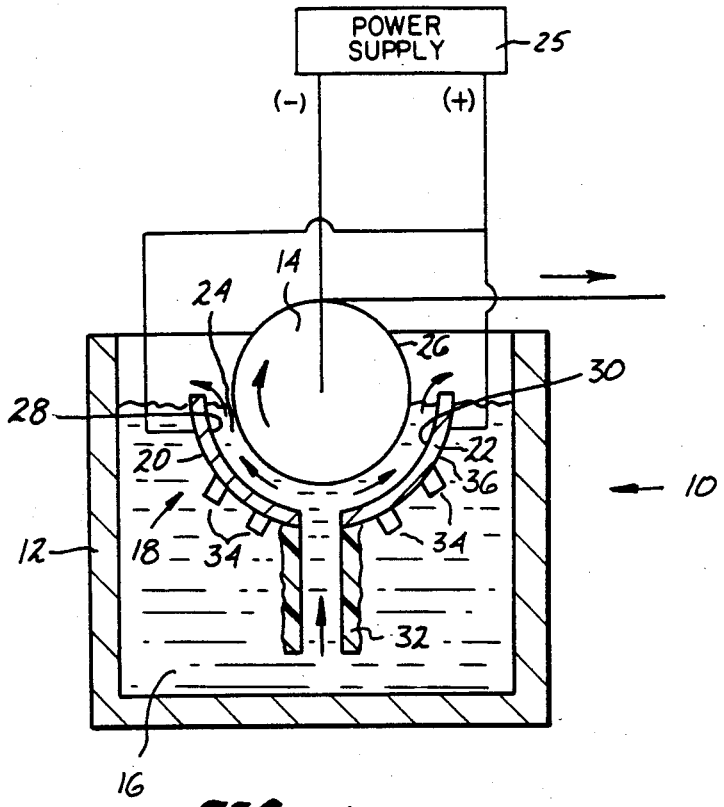
FIG. 1 is a cross-sectional view of an electroforming apparatus incorporating a series of sonic generators.

Referring now to the Figures, FIG. 1 illustrates a first embodiment of an electroforming apparatus in accordance with the present invention. The electroforming apparatus 10 comprises an electrochemical cell having a tank 12 for holding an electrolytic solution 16. The tank 12 may be formed from a suitable non-reactive material such as lead or stainless steel or may be formed from a structural material such as concrete. If a structural material is used, an inner lining not shown of a corrosion resistant material such as polyvinylchloride or rubber may be provided.

A cylindrical drum cathode 14 is mounted within the tank 12 for rotation about a desired axis, preferably a substantially horizontal axis. Any suitable mounting means (not shown) known in the art may be used to mount the cathode 14 within the tank so that it is at least partially immersed within the electrolytic solution 16. In a preferred arrangement, about half of the drum cathode extends beneath the surface of the electrolyte 16. The drum cathode 14 may be rotated by any suitable motor drive arrangement (not shown) known in the art.

The rotating drum cathode 14 may be formed from any suitable electrically conductive metal or metal alloy including lead, stainless steel, columbium, tantalum, titanium, chromium as well as alloys of these materials. In a preferred construction, the cathode 14 comprises a stainless steel drum having a polished plating surface 26 formed from titanium, columbium, tantalum or an alloy of these metals.

The anode 18 is preferably mounted in close proximity to the cathode 14 and comprises two arcuately shaped anode sections 20 and 22. The anode sections 20 and 22 may be mounted in the tank 12 using any suitable mounting means (not shown) known in the art. Preferably, they are mounted in the tank 12 to be substantially concentric with the cathode 14 and its plating surface 26. The primary purpose of providing such a cathode-anode arrangement is to form a substantially constant interelectrode gap 24 throughout the plating zone. While the cathode and anode can be arranged to provide an interelectrode gap having any desired size, there is a real limitation in that if the gap is too wide a significant IR loss may be created across the gap. Practically, this means that the width of the interelectrode gap 24 should be less than about 50 millimeters. Preferably, the width of the gap 24 is within the range of from about 5 millimeters to about 15 millimeters, most preferably from about 7 millimeters to about 11 millimeters.

The anode sections 20 and 22 may be formed from any electrically conductive material. Preferably, they are formed from an insoluble material such as lead, antimony, platinum or alloys of these materials. For example, each anode section could be formed from a lead-antimony alloy.

The anode 18 and the cathode 14 are connected via any suitable connecting means known in the art to a power supply 25. The power supply 25 may comprise any suitable conventional power supply known in the art. For example, power supply 25 may comprise means for applying either an A.C. or a D.C. current to the anode and cathode.

The electrolyte 16 in the tank 12 may comprise an aqueous acidic solution containing a concentration of ions of a metal or metals to be electrodeposited onto the cathode plating surface 26. For example, if copper is to be deposited onto the plating surface, the electrolyte 16 will contain a concentration of copper ions. A preferred solution for forming electrodeposited or E-D copper foil comprises a copper sulfate-sulfuric acid solution.

It has been found that electrolyte temperature affects the deposition rate. Thus from the standpoint of having an increased deposition rate, it is desirable to maintain the electrolyte temperature during the electroforming process within the range of from about room temperature to about 100° C., preferably from about 55° C. to about 65° C. Within these temperature ranges, the electrolytic solution may contain a concentration of copper ions in the form of copper sulfate within the range of from about 10 grams per liter, hereinafter g/l, to about 320 g/l, preferably from about 200 g/l to about 300 g/l. Sulfuric acid may be present in the electrolyte in a concentration up to that which causes the copper to precipitate out as copper sulfate. Preferably, the sulfuric acid concentration is within the range of from about 10 g/l to about 100 g/l. It should be recognized of course that the foregoing concentration ranges are temperature dependent and may have to be adjusted for electrolyte solutions maintained outside the foregoing temperature ranges. At elevated temperatures, the concentration of copper may be increased beyond the aforementioned upper limit because the solubility of copper increases with temperature.

The tank 12 may be provided with means not shown for maintaining the electrolyte temperature at a desired level. The temperature maintaining means may comprise any suitable means known in the art such as a heating/cooling loop.

To provide fresh electrolyte in a substantially continuous fashion into the plating zone, the apparatus 10 includes a central manifold 32. The manifold 32 extends in a direction parallel to the rotation axis of the drum cathode 14 and has a length substantially equal to the length of the cathode. The manifold has a width sufficient to provide a desired flow of electrolyte into the interelectrode gap 24. The manifold may be formed from any suitable material such as plastic and may be mounted in the tank 12 in any suitable fashion using any suitable mounting means (not shown) known in the art. The manifold communicates with a pump not shown to create a desired flow pattern within the tank. Any suitable pump known in the art may be used to create the desired flow pattern.

To agitate the electrolyte within the interelectrode gap during the electroforming process, the apparatus 10 is provided with one or more sonic generators 34, preferably ultrasonic generators. The generator(s) 34 may comprise any suitable sonic or ultrasonic generator known in the art. For example, each generator 34 may comprise an electromechanical transducer for converting electrical energy into mechanical vibrations in the sonic or ultrasonic frequency range. An appropriate electrical circuit not shown may be provided for energizing each transducer. The particular generators employed however should be capable of generating sufficient energy to obtain the desired moderately refined grain structure. Of course, the generator(s) should not be so large that excessive energy is created that degrades or destroys the foil being produced.

Figure 2:
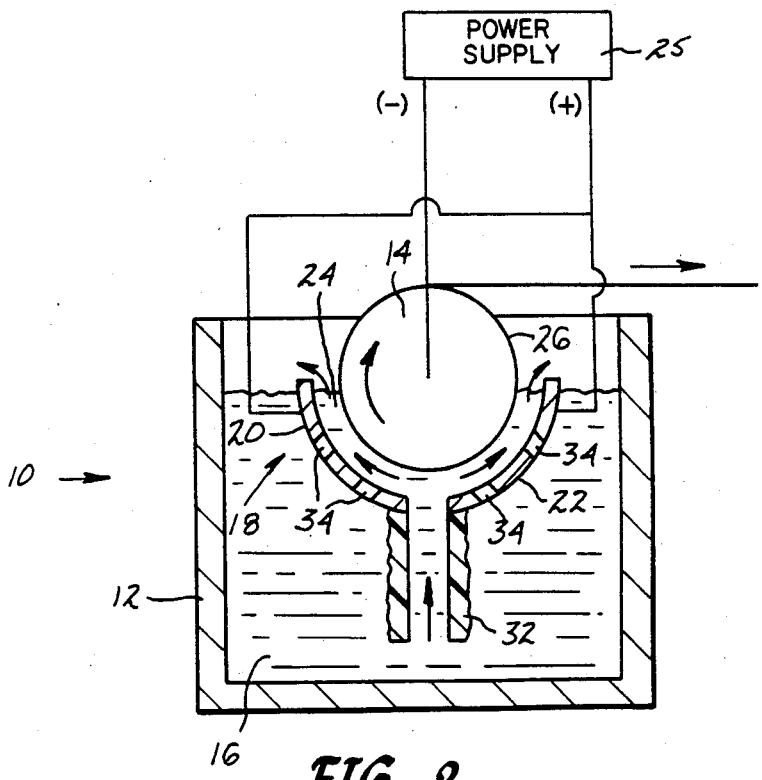
FIGS. 2–5 are cross-sectional views of alternative embodiments of the electroforming apparatus of the present invention.

The generator or generators 34 may be positioned in a number of locations. As shown in FIG. 1, sonic or ultrasonic generators 34 may be mounted to or placed in contact with the surface 36 of each anode section opposed to the respective surface 28 or 30 forming the interelectrode gap with the cathode. Alternatively, as shown in FIG. 2, one or more of the generators 34 may be incorporated within each anode section.

Figure 3:
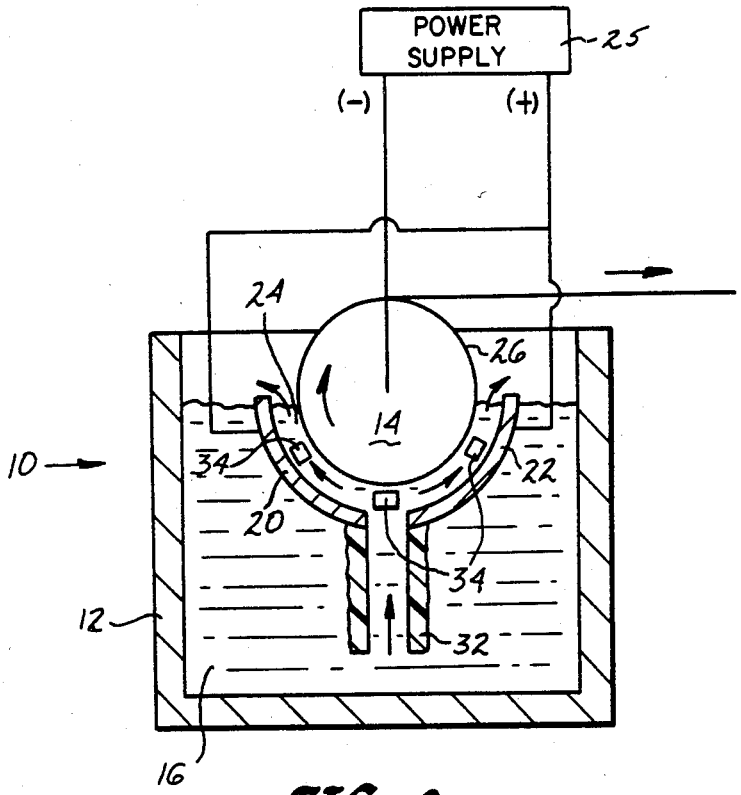

FIG. 3 illustrates another location for the generator(s) 34. In this figure, a generator 34 is positioned just above the outlet of the manifold 32 and within the electrolyte flow path. If desired, additional generators 34 may be positioned within the interelectrode gap 24.

Figure 4:
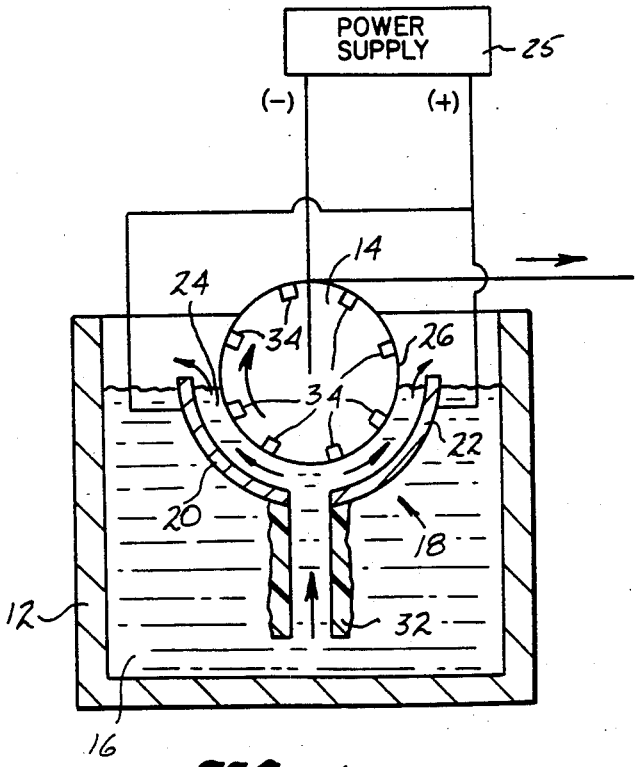
Figure 5:
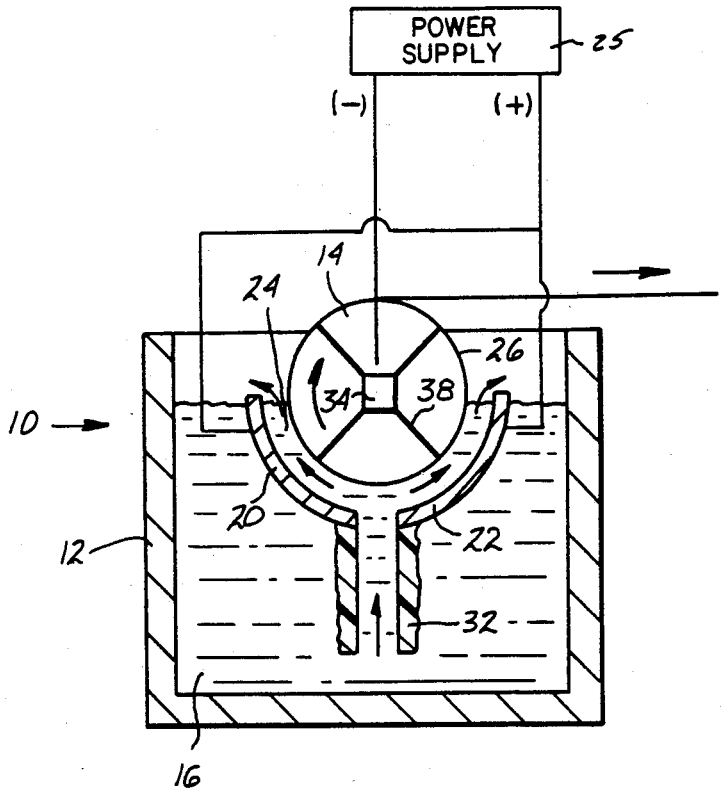

FIG. 4 illustrates still another location for the generator(s) 34. As shown in FIG. 4, a number of generators may be positioned within the the cathode 14 in contact with the surface opposed to the plating surface 26. Alternatively, as shown in FIG. 5, a generator 34 may be positioned centrally within the cathode. If such an arrangement is employed, the interior of the drum cathode 14 may either be filled with a fluid not shown or have a series of radial spokes 38 for transmitting the energy to the plating surface 26.

As previously discussed, it has been found that by sonically agitating and in particular ultrasonically agitating the electrolyte during the electroforming process, one is able to produce metal foil and strip having enhanced ductility and a moderately refined and substantially equalized grain structure without the use of plating additives. The moderate refinement in grain size is highly desirable because it permits, if desired, preservation of the fairly coarse surface roughness characteristic of electroformed foil which is useful in printed circuit applications while conveniently avoiding the embrittling effects of very small grain size. Additionally, if one increases the limiting current density through adjustment of one or more of the system's physical parameters, the process of the present invention permits attainment of the desired improvements in ductility and grain size at higher deposition rates under less strenuous operating conditions, i.e. lower electrolyte flow rates. For example, the process of the present invention may be carried out using an applied current density in the range of about 0.1 $A/cm^2$ to about 3.0 $A/cm^2$ and an electrolyte flow rate in the range of about 0.1 m/sec to about 3.0 m/sec. Preferably, the current density is maintained in the range of from about 0.6 $A/cm^2$ to about 2.0 $A/cm^2$ and the electrolyte flow rate is maintained in the range of from about 0.3 m/sec to about 2.0 m/sec. The ultrasonic generators may be operated at power levels to provide cathode surface energy densities in the range of from about 0.05 watts/cm$^2$ to about 20 watts/cm$^2$, preferably from about 0.1 watts/cm$^2$ to about 2.0 watts/cm$^2$.

The ability to use lower electrolyte flow rates is significant in that it has the effect of lowering pumping capacity requirements and concomitant erosive damage of the associated hardware. This, of course, reduces the expenses associated with maintaining and replacing the hardware components. Cavitation damage due to the ultrasonic activity can be prevented by appropriate choice of frequency, power level and transducer location.

To form continuous lengths of strip or foil, the cathode 14 is rotated at a desired speed and a current having a current density within the aforementioned ranges is applied to the cathode 14 and the anode 18. The electrolyte 16 is circulated through the system so that it flows upwardly through the manifold 32 into the interelectrode gap 24 between the anode and cathode, and back into the tank 12 by spilling over the edges of the anode sections 20 and 22. As previously mentioned, a pump not shown is used to create the desired electrolyte flow pattern. The rate of flow of electrolyte through the manifold 32 should be within the aforementioned flow rate range and should be sufficient to continually supply fresh electrolyte into the plating zone. As the electrolyte flows through the interelectrode gap 24, the generator(s) 34 agitate the solution so that fresh metal species to be deposited are presented to the moving plating surface 26.

While the plating surface 26 is immersed in the electrolyte 16 and the current is being applied, metal will be deposited thereon. The metal deposit will take the form of a substantially continuous strip having a moderately refined grain structure and an enhanced ductility. After the plating surface 26 emerges from the electrolyte, the metal strip may be removed or peeled from the surface. Any suitable means (not shown) known in the art may be used to remove the metal strip. For example, the metal strip removing means shown in U.S. Pat. No. 2,865,830 to Zoldas or U.S. Pat. No. 3,461,046 to Clancy, which are incorporated by reference herein, may be used. After the foil is removed from the cathode plating surface, it may be wound upon a suitable take-up reel (not shown).

To demonstrate the present invention, the following example was performed.

EXAMPLE

An electrolyte solution containing 1.7M $CuSO_4$ and 0.4M $H_2SO_4$ was prepared and purified by a three hour treatment with an aqueous 3% $H_2O_2$ solution followed by carbon filtration for three days. The solution was placed in a one liter tank containing a 1.25" diameter, 1" long titanium drum cathode and a concentric lead anode. The drum was operated at two different tangential velocities, 0.3 m/s and 0.6 m/s. The electrolyte solution was maintained at a temperature of 60° C. Copper foil having a thickness of 0.0014" was deposited on the drum using an applied current density of 1.0 A/cm$^2$.

Ultrasonic agitation was provided by means of an immersed cylindrical transducer manufactured by the Sonicor Instruments Corporation of Copiague, N.Y. The ultrasonic generator was operated at a power level of about 300 watts. Foil was produced both with and without ultrasonic agitation. The transducer was maintained in position in the electrolyte regardless of it being in operation in order to maintain constant flow conditions throughout the experiment.

Table I below illustrates the beneficial results of ultrasonic agitation during the electroforming process. In particular, the marked improvement in tensile elongation indicates the improvement in ductility of the metal foil that can be obtained by applying ultrasonic agitation. Tensile elongation was measured using standard mechanical tensile test procedures for foil. Additionally, microscopic inspection of representative cross section specimens revealed a reduction in the number and size of large grains.

TABLE I

| Tangential Mandrel Velocity (m/s) | Current Density (A/cm$^2$) | Ultrasonic Agitation | Tensile Elongation (% in 2") |
|---|---|---|---|
| 0.3 | 1.0 | No | 1.0 |
| 0.3 | 1.0 | Yes | 4.0 |
| 0.6 | 1.0 | No | 4.5 |
| 0.6 | 1.0 | Yes | 8.0 |

While the invention has been described in connection with the production of copper foil, the process and apparatus of the present invention is equally applicable to the production of other metal and metal alloy foils including but not limited to lead, tin, zinc, iron, nickel, gold, silver, and alloys thereof. Of course, the type of electrolyte, metal ion and acid concentrations in the electrolyte, the flow rate and the applied current density may have to be altered in accordance with the metal or metal alloy being deposited.

While the cathode has been described as being a rotating drum cathode, it is possible to use an endless belt type cathode if desired.

While particular locations for the sonic or ultrasonic generators have been described, one could use combinations of the aforementioned generator locations shown in the Figures. For example, one may have an electroforming system including one or more generators positioned within the drum cathode and one or more generators in contact with each anode section.

The patents and foreign patent publications set forth in the specification are intended to be incorporated by reference herein.

It is apparent that there has been provided in accordance with this invention metallurigcal structural control of electrodeposits using ultrasonic agitation which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed:

1. An apparatus for producing electroformed metal having enhanced ductility and a moderately refined grain structure, said apparatus comprising:

a tank for holding an electrolytic solution containing a concentration of metal ions to be deposited;

an anode and a cathode having a moving plating surface;

said anode and said plating surface of said cathode both being at least partially immersed in said solution;

means for applying a current to said anode and said cathode and for promoting deposition of said metal ions onto said immersed plating surface; and means for sonically agitating said electrolyte in contact with said moving plating surface.

2. The apparatus of claim 1 wherein said cathode comprises a rotating drum cathode.

3. The apparatus of claim 2 wherein said anode comprises two arcuately shaped, spaced-apart anode sections.

4. The apparatus of claim 3 further comprising:

said rotating drum cathode rotating about a first axis;

said anode sections being mounted within said tank so as to be substantially concentric with said cathode; and said anode and cathode defining a substantially constant interelectrode gap.

5. The apparatus of claim 1 wherein said sonic agitating means comprises at least one ultrasonic generator.

6. The apparatus of claim 5 further comprising:

each said ultrasonic generator being mounted to and in contact with a surface of said anode.

7. The apparatus of claim 5 further comprising:

each said ultrasonic generator being incorporated within said anode.

8. The apparatus of claim 5 further comprising:

said anode and cathode defining an interelectrode gap;

means for establishing electrolyte flow within said gap; and said at least one ultrasonic generator being positioned within said electrolyte flow in said gap.

9. The apparatus of claim 8 further comprising:

at least one ultrasonic generator positioned within said gap.

10. The apparatus of claim 5 further comprising:

said cathode comprising a rotating drum cathode; and said at least one ultrasonic generator being positioned within said drum cathode.

11. The apparatus of claim 10 further comprising:

each said ultrasonic generator contacting an interior surface of said drum cathode.

12. The apparatus of claim 10 further comprising:

said drum cathode having a plurality of spokes; and said at least one ultrasonic generator applying energy to a surface of said cathode through said spokes.

13. The apparatus of claim 10 further comprising:

said drum cathode being filled with a fluid; and said fluid transmitting ultrasonic energy from said at least one ultrasonic generator to a surface of said cathode.

14. A process for electroforming continuous lengths of metal having enhanced ductility and a moderately refined grain structure, said process comprising:

providing a tank containing an electrolytic solution having a concentration of metal values;

providing an anode and a cathode having a moving plating surface within said tank, said anode, cathode and plating surface all being at least partially immersed within said electrolytic solution;

applying an electrical current to said anode and said cathode for promoting the deposition of said metal values onto said at least partially immersed plating surface; and sonically agitating said electrolyte in the vicinity of said moving plating surface to promote formation of said metal lengths.

15. The process of claim 14 wherein said agitating step comprises applying ultrasonic energy to said electrolyte.

16. The process of claim 14 wherein said current applying step comprises applying a current having a current density in the range of from about 0.1 $A/cm^2$ to about 3.0 $A/cm^2$.

17. The process of claim 14 wherein said current applying step comprises applying a current having a current density in the range of from about 0.6 $A/cm^2$ to about 2.0 $A/cm^2$.

18. The process of claim 14 further comprising:

mounting said anode substantially concentric with said cathode so as to form a substantially constant interelectrode gap between said anode and said cathode; and flowing electrolyte into said gap at a rate in the range of about 0.1 m/sec to about 3.0 m/sec.

19. The process of claim 18 wherein said electrolyte flowing step comprises flowing said electrolyte into said gap at a rate in the range of about 0.3 m/sec to about 2.0 m/sec.

20. An electroformed metal foil having enhanced ductility and a moderately refined grain structure, said foil being formed by the process of claim 14.

21. The foil of claim 20 further comprising:

a relatively coarse surface roughness; and said grain structure being characterized by substantially equalized grain size.

* * * * *